US010526777B2

(12) United States Patent
Ke

(10) Patent No.: US 10,526,777 B2
(45) Date of Patent: Jan. 7, 2020

(54) PUMP-STORAGE DEVICE AND TRANSPORTATION TOOL INCLUDING THE SAME

(71) Applicant: Shih-Yuan Ke, Chia Yi Hsien (TW)

(72) Inventor: Shih-Yuan Ke, Chia Yi Hsien (TW)

( * ) Notice: Subject to any disclaimer, the term of this patent is extended or adjusted under 35 U.S.C. 154(b) by 0 days.

(21) Appl. No.: 15/956,694

(22) Filed: Apr. 18, 2018

(65) Prior Publication Data

US 2019/0177961 A1 Jun. 13, 2019

(30) Foreign Application Priority Data

Dec. 11, 2017 (TW) ..... 106143415 A

(51) Int. Cl.

| | |
|---|---|
| ***E03F 7/10*** | (2006.01) |
| ***F04B 23/02*** | (2006.01) |
| ***F04B 49/04*** | (2006.01) |
| ***E03F 1/00*** | (2006.01) |
| ***E03F 5/22*** | (2006.01) |

(Continued)

(52) U.S. Cl.

CPC ..... *E03F 1/006* (2013.01); *E03F 5/22* (2013.01); *E03F 7/10* (2013.01); *F04B 23/02* (2013.01); *F04B 43/113* (2013.01); *F04D 9/042* (2013.01); *B65D 88/22* (2013.01); *E03F 3/02* (2013.01); *F04B 49/04* (2013.01)

(58) Field of Classification Search

CPC ..... E03F 1/006; E03F 5/22; E03F 3/02; F04B 43/113; F04B 49/04; F04D 9/042; B65D 88/22; B01D 2201/165; B01D 2201/265; B01D 35/02; B01D 35/14; B01D 35/147

USPC .... 210/241, 258, 416.1, 386, 391, 395, 396; 251/289, 128, 129.16, 149, 144, 314, 251/149.1, 149.2, 149.3, 149.5, 318, 319, 251/330, 333, 357, 359, 361, 367, 89, 251/117, 120, 89.5, 90, 92, 95, 102; 137/386, 391, 393, 395, 396

See application file for complete search history.

(56) References Cited

U.S. PATENT DOCUMENTS 1,754,870 A * 4/1930 Wickes ..... B01D 21/14 210/801

2,179,246 A * 11/1939 Applebaum ..... C02F 1/5281 210/208

(Continued)

*Primary Examiner* — Nam X Nguyen
*Assistant Examiner* — Ekandra S. Miller-Cruz
(74) *Attorney, Agent, or Firm* — Symbus Law Group, LLC; Clifford D. Hyra

(57) ABSTRACT

A pump-storage device includes a tank, a treatment container, and a vacuum pump. The treatment container includes a first chamber in communication with an inlet. The first chamber includes a bottom wall having a first valve intercommunicated with a second chamber. The second chamber includes a bottom wall having a second valve. The treatment container includes a first control valve having a first duct in communication with the first chamber, a second duct in communication with the second chamber, and a third duct in communication with the tank. The treatment container includes an actuation cylinder for actuating an actuation rod to extend or retract. A first valve plate and a second valve plate are mounted on the actuation rod for controlling opening and closing of the first valve and the second valve. The treatment container includes a second control valve in communication with the first chamber and the vacuum pump.

16 Claims, 7 Drawing Sheets

(51) Int. Cl.

| | |
|---|---|
| ***F04B 43/113*** | (2006.01) |
| ***F04D 9/04*** | (2006.01) |
| *B65D 88/22* | (2006.01) |
| *E03F 3/02* | (2006.01) |

(56) References Cited

U.S. PATENT DOCUMENTS 3,302,575 A * 2/1967 Jennings ..... E03F 5/22
417/120
3,306,448 A * 2/1967 Baker ..... B01D 35/147
137/113
3,434,598 A * 3/1969 Daman ..... C02F 1/5281
210/199
3,515,370 A * 6/1970 Ung ..... F16K 47/04
251/120
7,461,829 B2 * 12/2008 Rule ..... F16J 3/041
251/318
8,574,430 B2 * 11/2013 Chajec ..... B01D 29/21
210/85

* cited by examiner

PUMP-STORAGE DEVICE AND TRANSPORTATION TOOL INCLUDING THE SAME

This application claims priority from Taiwan patent application 106,143,415, filed on Dec. 11, 2017, incorporated herein by reference.

BACKGROUND OF THE INVENTION

The present invention relates to a pump-storage device and, more particularly, to a pump-storage device that can be coupled to a transportation tool.

Populations are highly concentrated in cities due to urbanization. With the increase of the urban population, the consumption of water and sewage quantity increase, and the sewage treatment has become an important issue. Nowadays, sewage is delivered through sewage pipelines to sewage plants for proper treatment. However, sewage often carries oil stain, sludge, and debris, all of which flow into the treatment pipes, leading to blockage of the pipes. Periodic maintenance is necessary for smooth flow of the pipes. Sewage trucks are an important tool for cleaning substances, such as sludge in gutters, sewage in septic tanks, or chemical pollutants in chemical tanks. A sewage truck can deliver the substances blocking the pipes into a tank and can transport to a professional facility for treatment. A conventional sewage truck includes a tank for receiving substances. An end of an inlet is in communication with the tank. A vacuum pump is connected to the tank. Before sucking substances, the vacuum pump is started to expel the air in the tank, creating a vacuum state in the tank and a vacuum force. The other end of the inlet extends into a bottom of a gutter, a septic tank, or a chemical tank, such that the substances can enter the tank via the inlet.

However, the conventional pump-storage sewage truck has a larger tank and, thus, require a larger vacuum pump, increasing the manufacturing cost of the pump-storage sewage truck. Furthermore, it takes a longer time to create the vacuum state in the tank. Furthermore, when the pump-storage sewage truck proceeds with the vacuum operation, high-concentration volatile organic substances in the tank could be discharged to the atmosphere during the operation of the vacuum pump, leading to air pollution.

Thus, improvement to the conventional pump-storage devices is necessary.

BRIEF SUMMARY OF THE INVENTION

To solve the above problems, an objective of the present invention is to provide a pump-storage device that uses a smaller vacuum pump, that proceeds the cleaning operation in a short period of time, and that can reduce the amount of volatile gases discharged to the atmosphere when the pump-storage device receives volatile substances.

Another objective of the present invention is to provide a transportation tool having the pump-storage device.

A pump-storage device according to the present invention includes a tank, a treatment container, and a vacuum pump. The treatment container includes an inlet and a first chamber in communication with the inlet. The first chamber includes a bottom wall having a first valve in communication with a second chamber. The second chamber includes a bottom wall having a second valve. The treatment container includes a first control valve. The first control valve includes a first duct in communication with the first chamber, a second duct in communication with the second chamber, and a third duct in communication with the tank. The treatment container includes an actuation cylinder for actuating an actuation rod to extend or retract. A first valve plate and a second valve plate are mounted on the actuation rod for controlling opening and closing of the first valve and the second valve. The treatment container includes a second control valve in communication with the first chamber. The vacuum pump intercommunicates with the second control valve via a tube.

Thus, the pump-storage device according to the present invention uses the pressure difference between the treatment container and the ambient air to suck the substances into the treatment container. Then, the actuation cylinder is actuated to move the sucked substances from the treatment container into the tank. Since the vacuum pump only has to suck the air in the treatment container of a size smaller than the tank, the pump-storage device according to the present invention can significantly reduce the time for discharging the gas by the vacuum pump in comparison with conventional operations proceeding suction of the gas in the tank. Thus, a small-size vacuum pump is sufficient to achieve the sucking effect for the treatment container of a smaller size, reducing the cost of the pump-storage device according to the present invention. Furthermore, when the pump-storage device according to the present invention is used to suck volatile substances, since only vacuum suction of the treatment container is required, the volatile gases of the volatile substances that have been received in the treatment container will not be discharged by the vacuum pump, reducing the air pollution. Furthermore, the pump-storage device can be installed on a transportation tool, permitting easy delivery and transportation of the substances.

In an example, the inlet of the treatment container includes a swirling member. Thus, sludge, fecal sewage, or chemical pollutants entering the treatment container via the inlet can create a stable swirling flow without incurring large dissipation or large volatilization resulting from impact.

In an example, the actuation cylinder includes a push rod coupled with the actuation rod via a coupler. Thus, the push rod can be detached from the actuation rod to permit easy maintenance and replacement.

In an example, a first annular block and a second annular block are respectively mounted above and below the first valve plate. A spacing between the first annular block and the second annular block is larger than a thickness of the first valve plate. A third annular block and a fourth annular block are respectively mounted above and below the second valve plate. A spacing between the third annular block and the fourth annular block is larger than a thickness of the second valve plate. Thus, the actuation rod can indirectly actuate the first valve plate and the second valve plate.

In an example, the treatment container includes a protection unit having a compartment. The compartment includes a bottom having at least one bottom hole in communication with the first chamber. The compartment includes a top having a vent in communication with a passage. A float is received in the compartment. The float is floatable in the compartment to permit a gas to flow between the first chamber and the compartment. Thus, the protection unit can interrupt flow of the gas between the first chamber and the passage to prevent the substances from keep entering the first chamber, preventing damage to the pump-storage device.

In an example, the float is floatable upward to block the vent to thereby prevent the gas to flow between the first chamber and the passage, thereby preventing the gas to flow between the first chamber and the passage. Thus, when the first chamber is full with the substances, the float can block the vent to stop flow of the gas.

In an example, the actuation rod is received in a shaft sleeve, and the shaft sleeve is connected to an inner wall of the first chamber by a connecting rod. Thus, the shaft sleeve can support rectilinear axial movement of the actuation rod.

In an example, the treatment container includes a filtering unit connected to the second control valve via a gas inlet. The filtering unit includes a filter therein. The filter intercommunicates with the vacuum pump via the tube. Thus, the gas sucked from the first chamber can be discharged via the tube after filtration by the filter.

In an example, the filtering unit includes a relief valve. Thus, when the pressure in the second chamber and the first chamber are abnormal, the relief valve is opened to introduce ambient air into the relief valve, and the air flows outward via the tube, avoiding damage to the vacuum pump resulting from idling operation.

The present invention will become clearer in light of the following detailed description of illustrative embodiments of this invention described in connection with the drawings.

DETAILED DESCRIPTION OF THE INVENTION

Figure 1:
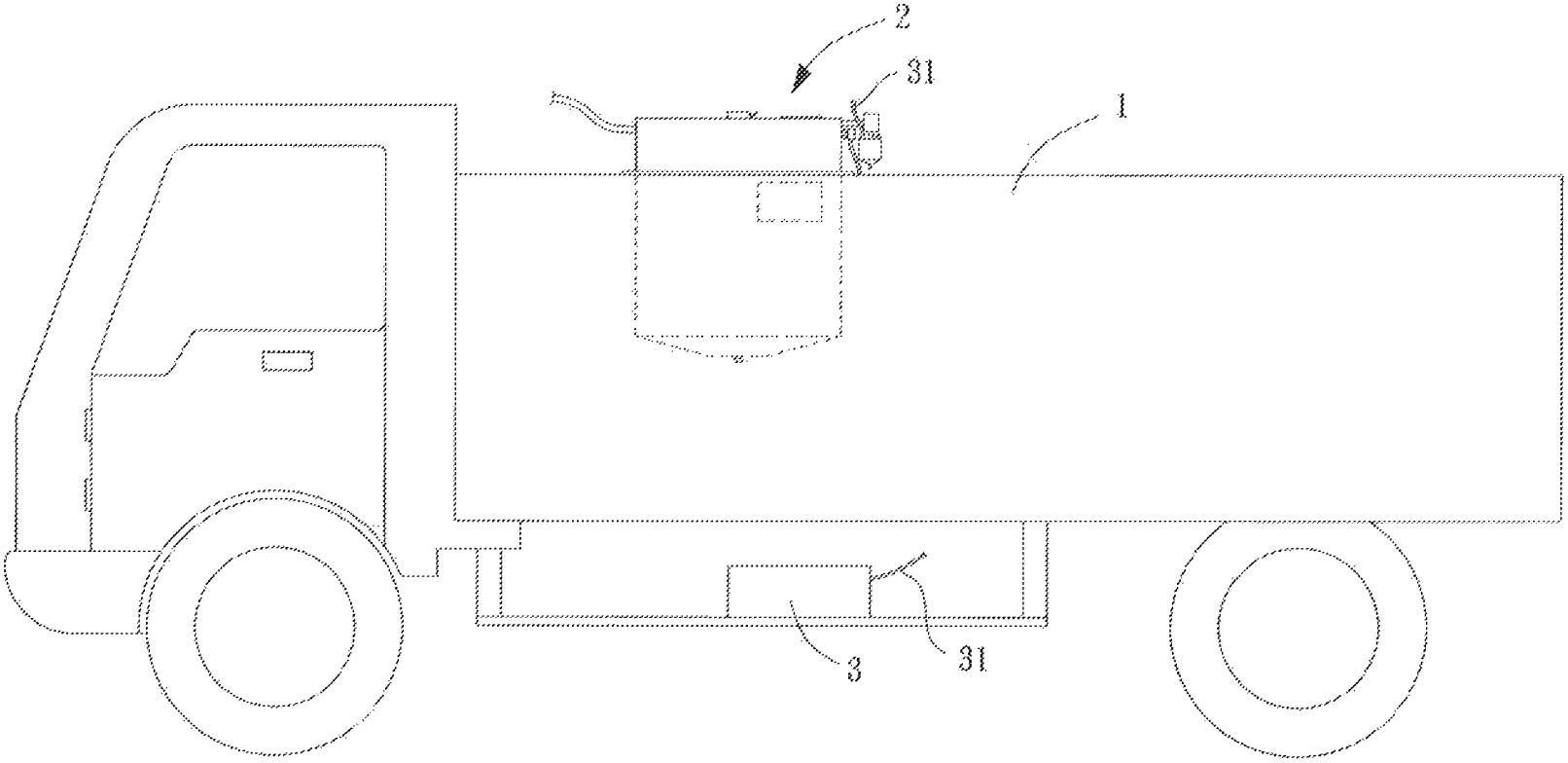
FIG. 1 is a diagrammatic view of a transportation tool including a pump-storage device of an embodiment according to the present invention.

FIG. 1 is a diagrammatic view of a transportation tool including a pump-storage device of an embodiment according to the present invention. The pump-storage device includes a tank 1, a treatment container 2, and a vacuum pump 3. The treatment container 2 is connected to the tank 1. The vacuum pump 3 is connected to the treatment container 2 via a tube 31. The pump-storage device can be installed on a transportation tool to permit easy delivery and transportation of substances.

The tank 1 includes a receiving space for storing substances. The tank 1 can be made of stainless steel, high carbon steel, or aluminum alloy and can be selected according to the properties of the substances to be loaded, all of which are not limited in the present invention.

Figure 2:
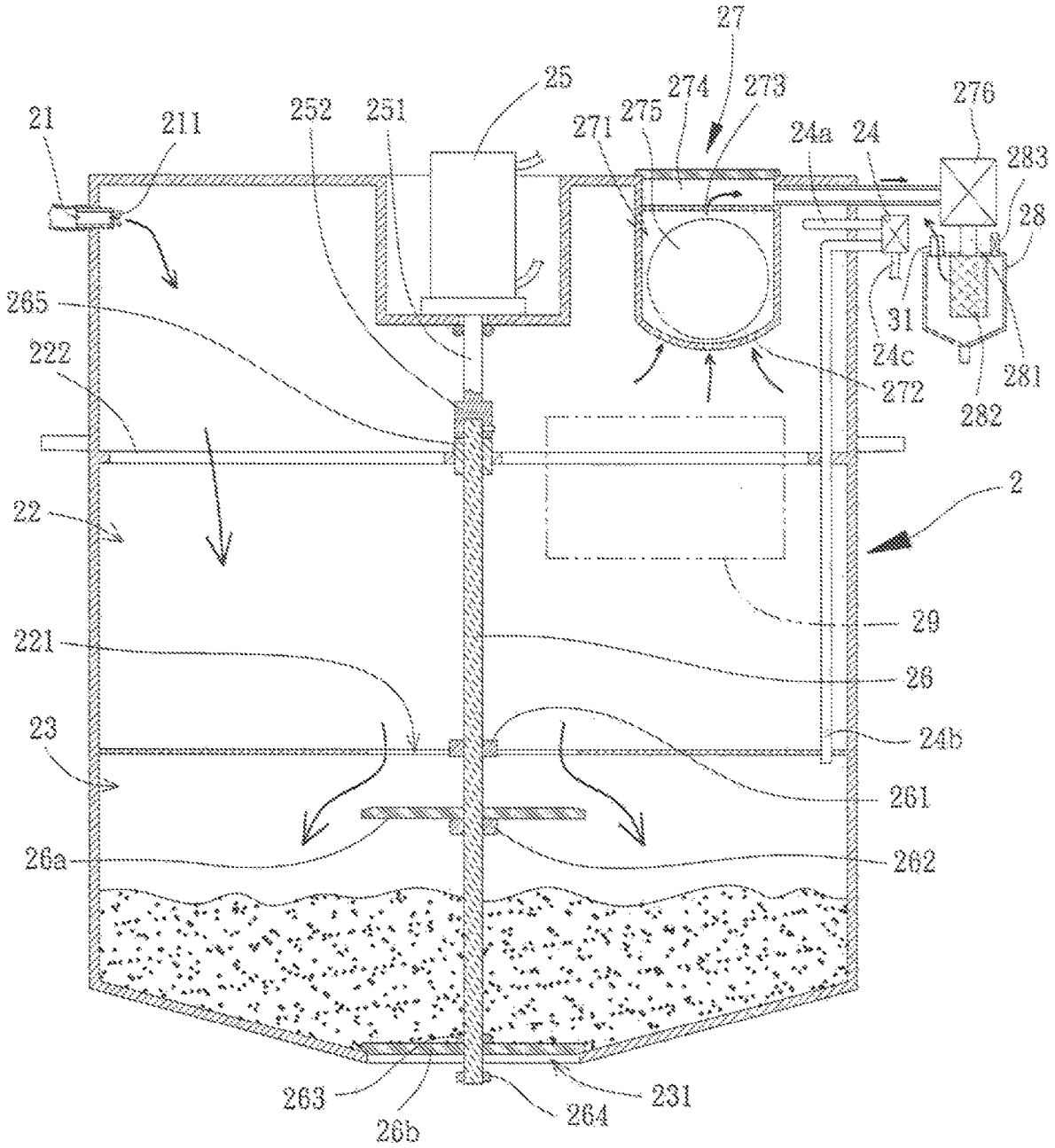
FIG. 2 is a diagrammatic cross sectional view of a treatment tank of the pump-storage device according to the present invention.

With reference to FIG. 2, the treatment container 2 includes an inlet 21 in communication with a feeding tube, such that an end of the inlet 21 can approach a substances to be sucked and such that the substances can enter the treatment container 2 via the inlet 21. Preferably, the inlet 21 includes a swirling member 211, such that sludge, fecal sewage, or chemical pollutants entering the treatment container 2 via the inlet 21 can create a stable swirling flow without incurring large dissipation or large volatilization resulting from impact. The treatment container 2 includes a first chamber 22 in communication with the inlet 21. The first chamber 22 includes a bottom wall having a first valve 221 in communication with a second chamber 23. The second chamber 23 includes a bottom wall having a second valve 231 for intercommunicating the second chamber 23 with the tank 1.

The treatment container 2 includes a time control member (not shown) and a control unit (not shown). The time control member can be set to activate the control unit to actuate a first control valve 24 at a predetermined time. The first control valve 24 includes a first duct 24*a* in communication with the first chamber 22, a second duct 24*b* in communication with the second chamber 23, and a third duct 24*c* in communication with the tank 1. The first control valve 24 can control intercommunication and closing between the first duct 24*a* and the second duct 24*b* and can control intercommunication and closing between the second duct 24*b* and the tank 1. The first control valve 24 can be a pneumatic valve or an electromagnet valve, which is not limited in the present invention.

The treatment container 2 includes an actuation cylinder 25. The time control member and the control unit can be set to activate the control unit to actuate the actuation cylinder 25 at a predetermined time. The actuation cylinder 25 can be a pneumatic cylinder or a hydraulic cylinder, which is not limited in the present invention. In this embodiment, the actuation cylinder 25 is a pneumatic cylinder. The actuation cylinder 25 can actuate a push rod 251 to extend or retract. An end of the push rod 251 is connected to an actuation rod 26. Preferably, the push rod 251 is coupled with the actuation rod 26 via a coupler 252, and the push rod 251 can be detached from the actuation rod 26 for easy maintenance and replacement. A first valve plate 26*a* and a second valve plate 26*b* are mounted on the actuation rod 26. The first valve plate 26*a* controls opening and closing of the first valve 221, and the second valve plate 26*b* controls opening and closing of the second valve 231. To achieve control of opening and closing by the first valve plate 26*a* and the second valve plate 26*b*, a first annular block 261 and a second annular block 262 are respectively mounted above and below the first valve plate 26*a*, and a third annular block 263 and a fourth annular block 264 are respectively mounted above and below the second valve plate 26*b*.

A spacing between the first annular block 261 and the second annular block 262 is larger than a thickness of the first valve plate 26*a*. A spacing between the third annular block 263 and the fourth annular block 264 is larger than a thickness of the second valve plate 26*b*. The first valve plate 26*a* and the second valve plate 26*b* can move axially relative to the actuation rod 26. The first annular block 261, the second annular block 262, the third annular block 263, and the fourth annular block 264 are fixed on the actuation rod 26. When the actuation rod 26 moves axially, the first annular block 261 and the second annular block 262 push the first valve plate 26*a* to control opening and closing of the first valve 221, and the third annular block 263 and the fourth annular block 264 push the second valve plate 26*b* to control opening and closing of the second valve 231. Preferably, the actuation rod 26 is received in a shaft sleeve 265. The shaft sleeve 265 is connected to an inner wall of the first chamber 22 by a connecting rod 222. Thus, the shaft sleeve 265 can support rectilinear axial movement of the actuation rod 26.

The treatment container 2 includes a protection unit 27 having a compartment 271. The compartment 271 includes a bottom having at least one bottom hole 272 in communication with the first chamber 22. The compartment 271 includes a top having a vent 273 in communication with a passage 274. A float 275 is received in the compartment 271. The float 275 has a smaller density. The float 275 is floatable in the compartment 271 to avoid from blocking all of the bottom holes 272, permitting a gas to flow between the first chamber 22 and the compartment 271. When the substances flow from the at least one bottom hole 272 into the compartment 271, the float 275 floats upward due to buoyance and blocks the vent 273 to thereby prevent the gas to flow between the first chamber 22 and the passage 274.

The treatment container 2 further includes a second control valve 276 in communication with the passage 274 and the tube 31. After the second control valve 276 is opened, the vacuum pump 3 can suck the gas in the first chamber 22 and the second chamber 23, such that vacuum can be created in the first chamber 22 and the second chamber 23. Thus, the pressures in the first chamber 22 and the second chamber 23 are smaller than the atmospheric pressure.

Preferably, the treatment container 2 includes a filtering unit 28. The filtering unit 28 includes a filter 282 therein for filtering the gas flowing out of the first chamber 22, thereby intercepting particles or debris in the gas. After filtration by the filter 282, the gas in the first chamber 22 enters the vacuum pump 3 via the tube 31 and then exits the pump-storage device via the vacuum pump 3. In this embodiment, the filtering unit 28 includes a gas inlet 281 in communication with the second control valve 276. After the gas has entered the filtering unit 28 via the gas inlet 281, the gas is filtered by the filter 282 and is then discharged via the tube 31. The filtering unit 28 further includes a relief valve 283 that is normally closed to isolate the filtering unit 28 and the atmosphere. Nevertheless, when the pressure in the compartment 271 is abnormal, the relief valve 283 is opened automatically to introduce ambient air into the relief valve 283, and the air flows outward via the tube 31, avoiding damage to the vacuum pump 3. Preferably, the treatment container 2 includes a maintenance opening 29. A lid is detachably mounted to seal the maintenance opening 29 and can be removed for easy maintenance.

With reference to FIGS. 1 and 2, the vacuum pump 3 and the second control valve 276 are connected by the tube 31, such that the gas in the first chamber 22 can be discharged out of the pump-storage device by the vacuum pump 3.

Figure 3:
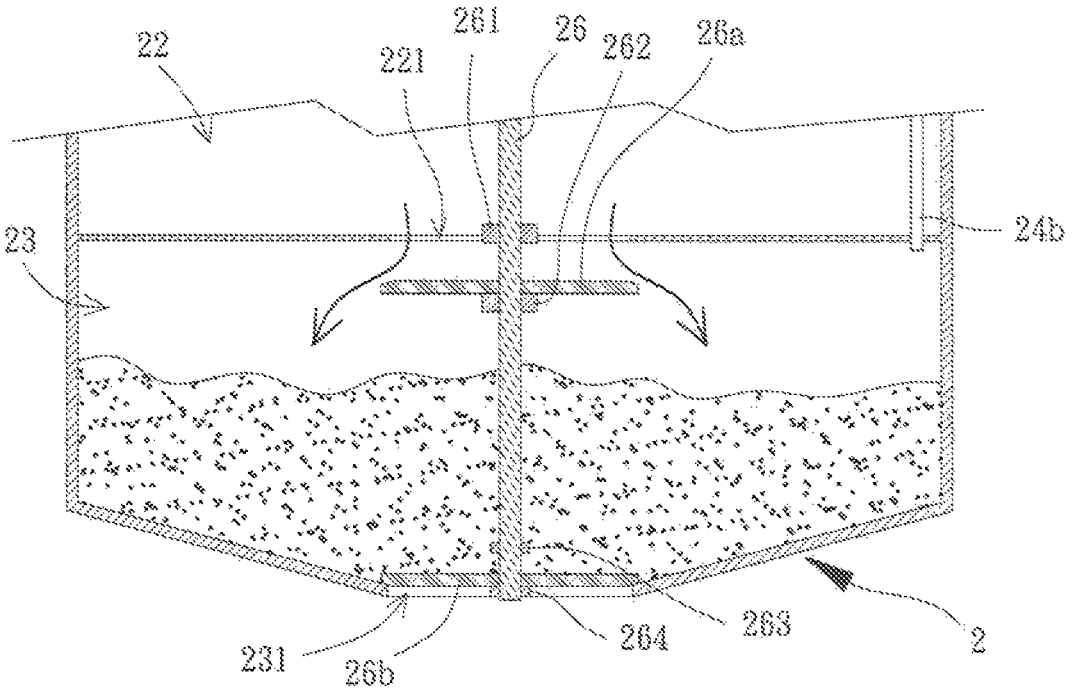
FIG. 3 shows a portion of the treatment tank of FIG. 2.

With reference to FIGS. 2 and 3, when it is desired to suck the substances into the treatment container 2, the time control member actuates the first control valve 24, the second control valve 276, and the vacuum pump 3 to open simultaneously and actuates the actuation cylinder 25. The first control valve 24 is opened to intercommunicate the first duct 24*a* with the second duct 24*b*. At the same time, the second duct 24*b* does not intercommunicate with the third duct 24*c*. The passage 274 intercommunicates with the gas inlet 281 when the second control valve 276 opens. When the vacuum pump 3 is activated, the continuous gas sucking effect makes a portion of the air in the first chamber 22 to flow through the compartment 271, the passage 274, the second control valve 276, the gas inlet 281, and the tube 31 into the tank 1, and a vacuum state is gradually created in the first chamber 22 and the second chamber 23. The push rod 251 of the actuation cylinder 25 actuates the actuation rod 26 to extend downward, and the first annular block 261 moves downward and pushes the first valve plate 26*a*, such that the first valve plate 26*a* disengages from the first valve 221 and falls onto the second annular block 262. Furthermore, the third annular block 263 moves downward and pushes the second valve plate 26*b*, such that the second valve plate 26*a* closes the second valve 231. Thus, the second chamber 22 is isolated from the tank 1 to shorten the time for creating the vacuum state in the first chamber 22 and the second chamber 23. Since the inlet includes the swirling member 211, such that substances (such as sludge, fecal sewage, or chemical pollutants) entering the treatment container 2 via the inlet 21 into the first chamber 22 and the second chamber 23 can swirl stably without incurring large dissipation or large volatilization resulting from impact.

Figure 4:
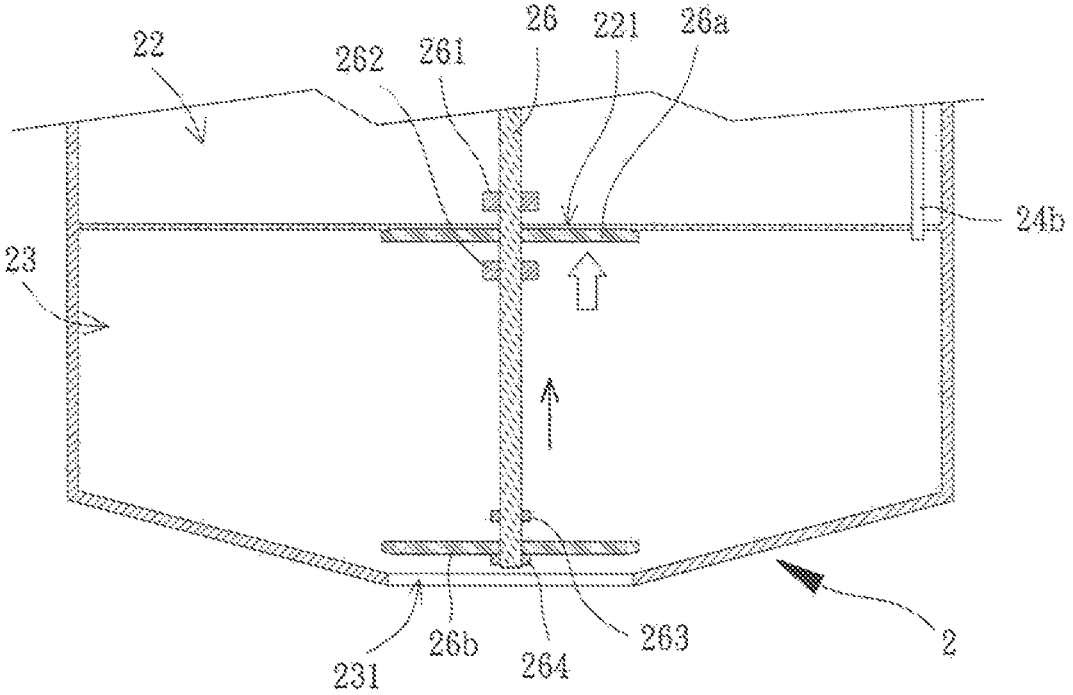
FIG. 4 is a view similar to FIG. 3, with an actuation rod moved upward.
Figure 5:
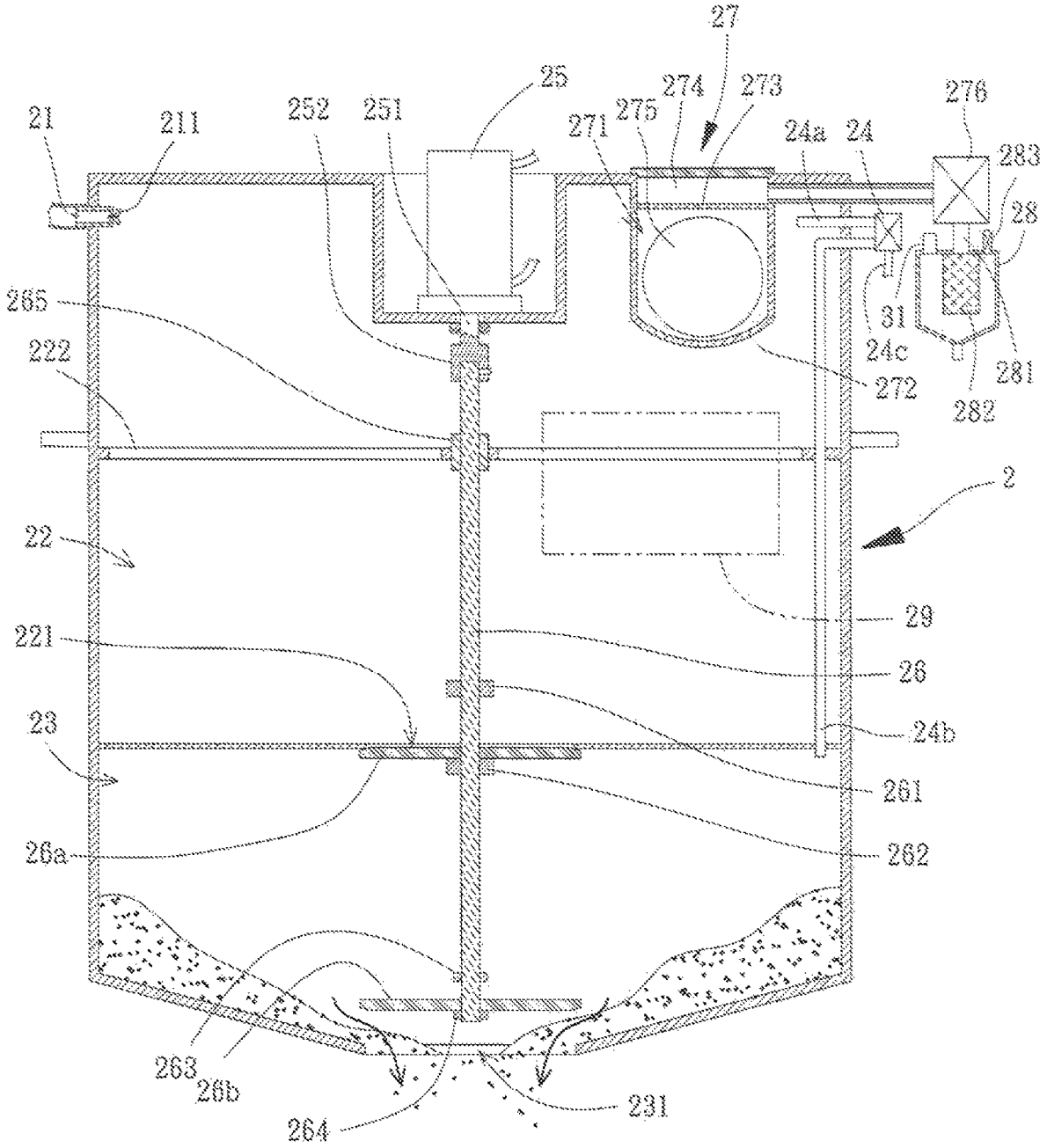
FIG. 5 is a view similar to FIG. 2, with a first valve closed and with a second valve opened.

With reference to FIG. 4, when the predetermined time for suction is reached, the control unit activates the first control valve 24 to switch, such that the second duct 24*b* intercommunicates with the third duct 24*c*, and such that the first duct 24*a* does not intercommunicate with the second duct 24*b*. Furthermore, the control unit controls the actuation cylinder 25 to retract. During upward retraction of the actuation rod 26, since the first valve plate 26*a* has fallen onto the second annular block 262, the second annular block 262 firstly carries the first valve plate 26*a* upward. At this time, the fourth annular block 264 is still spaced from the second valve 231 and the second valve plate 26*b*. When the first valve plate 26*a* approaches the first valve 221, since the first duct 24*a* does not intercommunicate with the second duct 24*b*, the first chamber 22 has a pressure difference from the second chamber 23 due to continuous suction. Due to the pressure difference between the first chamber 22 and the second chamber 23, the first valve plate 26*a* is rapidly moved toward the first valve 221 to thereby close the first valve 221, thereby isolating the first chamber 22 from the second chamber 23. Although the first control valve 24 switches to create intercommunication between the second duct 24*b* and the third duct 24*c*, the second chamber 23 is not in a vacuum state, because the second chamber 23 intercommunicates with the tank 1. After the fourth annular block 264 comes in contact with the second valve plate 26*b*, the fourth annular block 264 pushes the second valve plate 26*b* upward to open the second valve 231 (see FIG. 5). At this time, the substances that have been stored in the second chamber 23 fall through the second valve 231 into the tank 1. Since the first valve 221 has been closed by the first valve plate 26*a*, the first chamber 22 remains in the vacuum state.

After the push rod 251 of the actuation cylinder 25 has retracted for a predetermined period of time, the control unit actuates the actuation cylinder 25 again, and the push rod 251 actuates the actuation rod 26 downward again to disengage the first valve plate 26*a* from the first valve 221, thereby opening the first valve 221. Furthermore, the second plate 26*b* closes the second valve 231 again. At the same time, the control unit controls the first valve 24 to switch, such that the first duct 24*a* intercommunicates with the second duct 24*b*, and such that the second duct 24*b* does not intercommunicate with the third duct 24*c*. Thus, a vacuum state is gradually created in the second chamber 23. When the pressure in the second chamber 23 is equal to the pressure in the first chamber 22, the first valve plate 26*a* in the first chamber 22 slides downward onto the second annular block 262 along the actuation rod 26 due to the weight of the substances (such as sludge, fecal sewage, or chemical pollutants), such that the first valve 221 is in an open state (as shown in FIG. 2), and such that the substances (such as sludge, fecal sewage, or chemical pollutants) in the first chamber 22 can fall into the second chamber 23. Thus, the time control member actuates the actuation cylinder 25 according to the predetermined time schedule to repeatedly extend and retract the actuation rod 26, such that the substances can be continuously sucked into the first chamber 22 and the second chamber 23 of the treatment container 2 and then moves into the tank 1.

Figure 6:
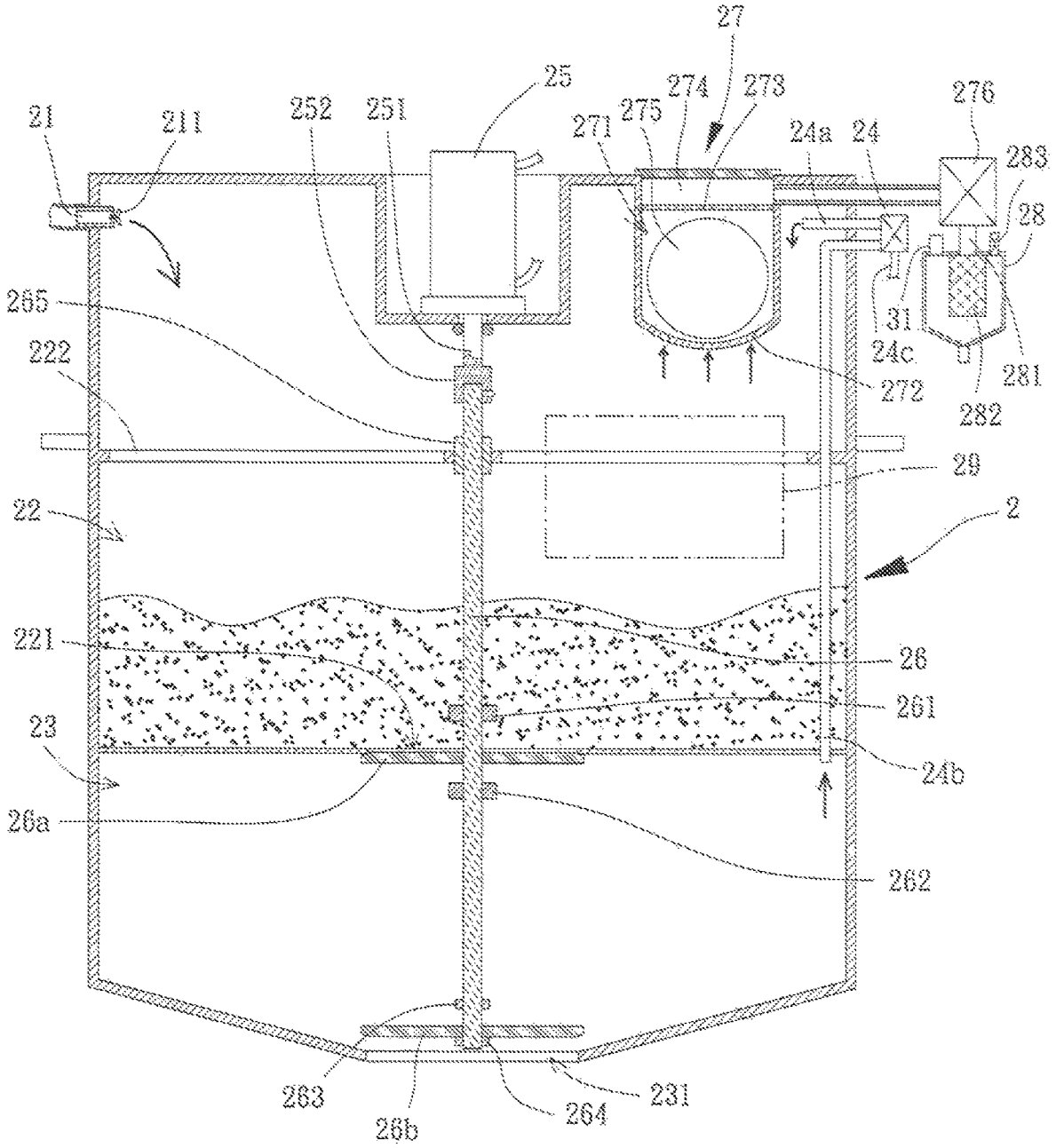
FIG. 6 is a view similar to FIG. 2, with the actuating rod failed to extend downward in a case of malfunction.
Figure 7:
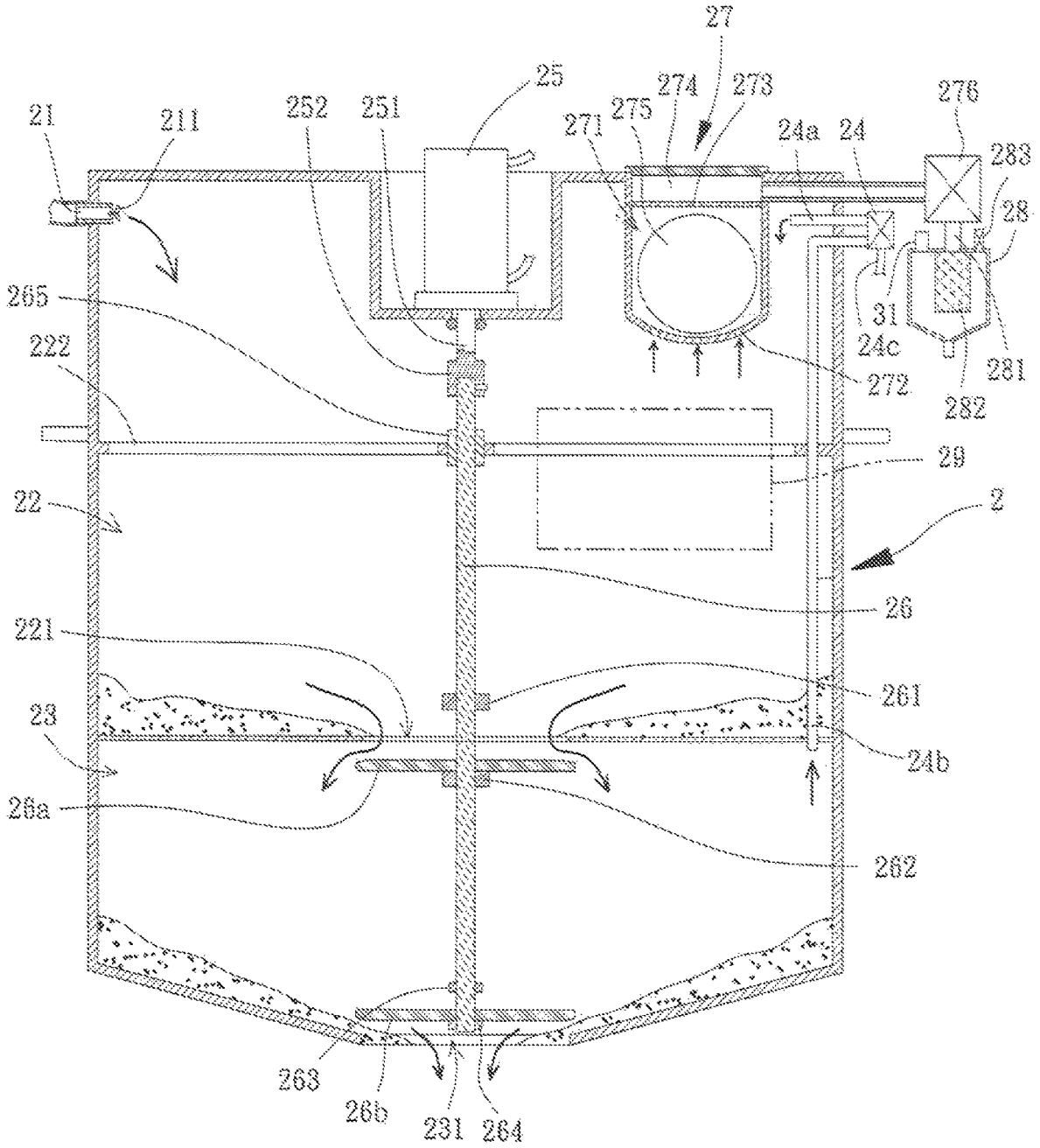
FIG. 7 is a view similar to FIG. 6, with a first valve plate fallen on a second annular block in the case of malfunction.

With reference to FIG. 6, when the push rod 251 cannot move the actuation rod 26 downward due to the fact that the time control member is out of order or the actuation cylinder 25 malfunctions. Although the second valve plate 26*b* on the actuation rod 26 cannot close the second valve 231 due to out of order or malfunction, when the push rod 251 of the actuation cylinder 25 pushes the actuation rod 26 downward, the first control valve 24 makes the first duct 24*a* intercommunicate with the second duct 24*b*. As a result, the second chamber 23 gradually turns into the vacuum state. When the pressure in the second chamber 23 is equal to the pressure in the first chamber 22, due to the weight of the substances (such as sludge, fecal sewage, or chemical pollutants), the first valve plate 26*a* can slide along the actuation rod 26 onto the second annular block 262 (as shown in FIG. 7). Thus, the first valve 221 is opened, and the substances (such as sludge, fecal sewage, or chemical pollutants) in the first chamber 22 can enter the second chamber 23 via the first valve 221 and then fall into the tank 1 via the second valve 231. Thus, even if the actuation rod 25 malfunctions, normal operation can still proceed without causing danger.

Figure 8:
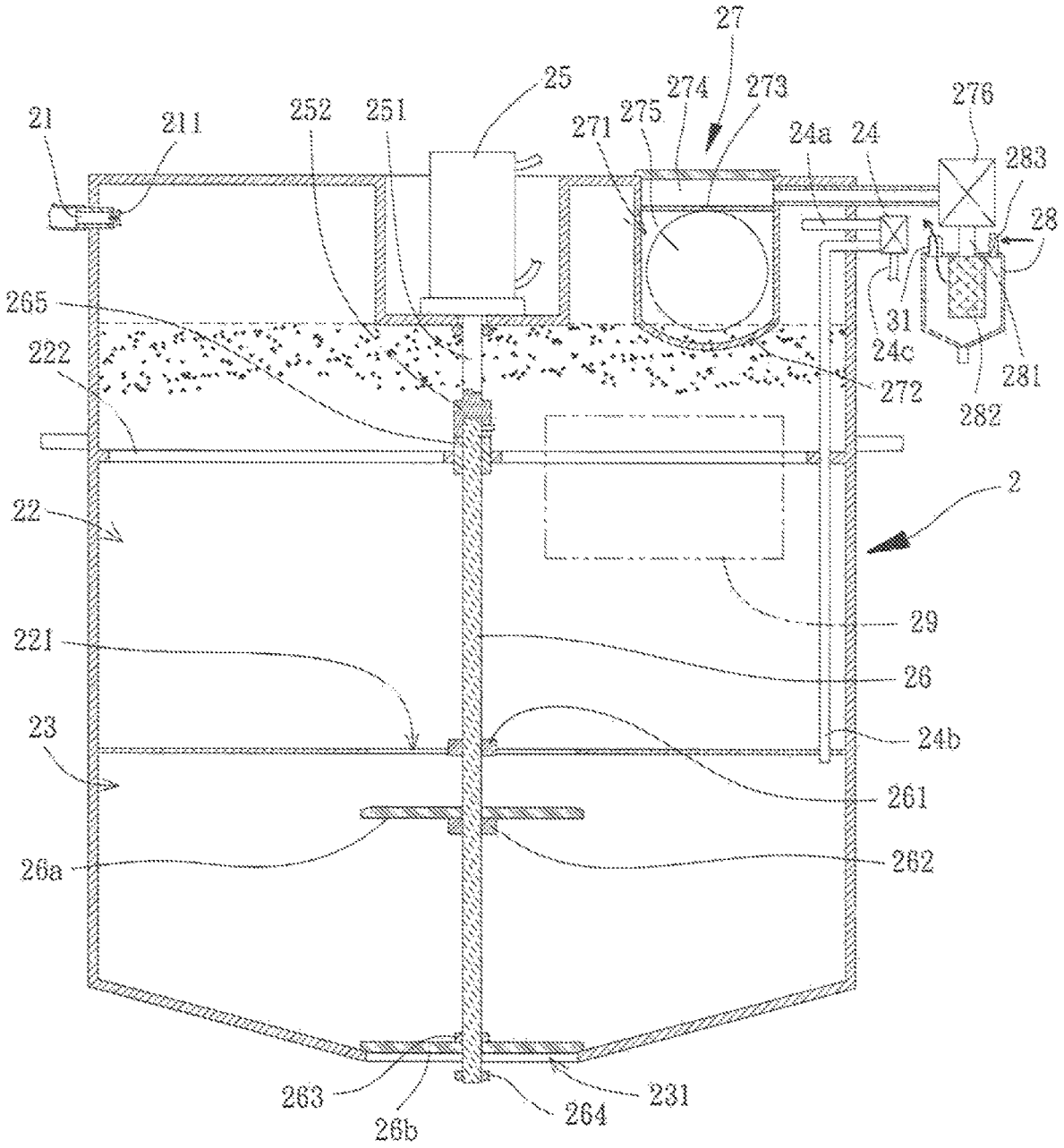
FIG. 8 is a view similar to FIG. 2, with the actuating rod failed to retract in the case of malfunction.

With reference to FIG. 8, when the push rod 251 cannot retract the actuation rod 26 due to the fact that the time control member is out of order or the actuation cylinder 25 malfunctions, the second valve plate 26*b* on the actuation rod 26 cannot open the second valve 231, and the first control valve 24 is closed such that the first duct 24*a* does not intercommunicate with the second duct 24*b*. In this case, the substances (such as sludge, fecal sewage, or chemical pollutants) in the second chamber 23 cannot fall into the tank 1 through the second valve 231. At the same time, the first valve plate 26*a* does not close the first valve 221. Thus, the second chamber 23 and the first chamber 22 are full with the substances (such as sludge, fecal sewage, or chemical pollutants). As a result, these substances can flow through the at least one bottom hole 272 into the compartment 271 to push the float 275 upward to thereby block the vent 273 at the top of the compartment 271, isolating flow of the gas in the first chamber 22 and the passage 274 and thereby avoiding the substances (such as the sludge, fecal sewage, or chemical pollutants) from flowing outward. Furthermore, when the pressure in the second chamber 23 and the first chamber 22 are abnormal, the relief valve 283 is opened to introduce ambient air into the relief valve 283, and the air flows outward via the tube 31, avoiding damage to the vacuum pump 3 resulting from idling operation and preventing from the substances (such as sludge, fecal sewage, or chemical pollutants) from continuously entering the first chamber 22.

The pump-storage device according to the present invention can proceed with vacuum operation of the treatment container 2 of a smaller size. In an example of a treatment container 2 having a radius of 42.5 cm and a height of 65 cm, the volume is 368,655 $cm^3$ (42.5 cm×42.5 cm×3.14×65 cm). The cross sectional contact area between the volatile organic substances in the treatment container 2 and the vacuum area in the treatment container 2 is only 5,671 $cm^2$ (42.5 cm×42.5 cm×3.14). Taking a tank 1 having a radius of 97.5 cm and a height of 560 cm as an example, the volume is 16,715,790 $cm^3$ (97.5 cm×97.5 cm×3.14×560 cm). In a conventional pumping operation of the tank 1, the cross sectional contact area between the volatile organic substances in the treatment container 2 and the vacuum area in the treatment container 2 is 109,200 $cm^2$ (97.5 cm×2×560 cm), which is 19.26 (109,200/5,671) times of that of the pump-storage device according to the present invention. Namely, the pump-storage device according to the present invention can reduce the air pollution by nearly 95%, because the air pollution caused by the pump-storage device according to the present invention is only about 5% (1/19.26) of that caused by conventional operations for treating the tank 1. Furthermore, the time required for sucking the treatment container 2 of a smaller size is 45 (16,715,790 $cm^3$/368,655 $cm^3$) times fastener than that required by conventional operations for treating the tank 1.

In view of the foregoing, the pump-storage device according to the present invention uses the pressure difference between the treatment container 2 and the ambient air to suck the substances into the treatment container 2. Then, the actuation cylinder 25 is actuated to move the sucked substances from the treatment container 2 into the tank 1. Since the vacuum pump 3 only has to suck the air in the treatment container 2 of a size smaller than the tank 1, the pump-storage device according to the present invention can significantly reduce the time for discharging the gas by the vacuum pump 3 in comparison with conventional operations proceeding suction of the gas in the tank 1. Thus, a small-size vacuum pump 3 is sufficient to achieve the sucking effect for the treatment container 2 of a smaller size, reducing the cost of the pump-storage device according to the present invention. Furthermore, when the pump-storage device according to the present invention is used to suck volatile substances, since only vacuum suction of the treatment container 2 is required, the volatile gases of the volatile substances that have been received in the treatment container 2 will not be discharged by the vacuum pump 3, reducing the air pollution. Furthermore, the pump-storage device can be installed on a transportation tool, permitting easy delivery and transportation of the substances.

Although specific embodiments have been illustrated and described, numerous modifications and variations are still possible without departing from the scope of the invention. The scope of the invention is limited by the accompanying claims.

The invention claimed is:

1. A pump-storage device comprising:

a tank;

a treatment container including an inlet and a first chamber in communication with the inlet, wherein the first chamber includes a bottom wall having a first valve in communication with a second chamber, wherein the second chamber includes a bottom wall having a second valve, wherein the treatment container includes a first control valve, wherein the first control valve includes a first duct in communication with the first chamber, a second duct in communication with the second chamber, and a third duct in communication with the tank, wherein the treatment container includes an actuation cylinder for actuating an actuation rod to extend or retract, wherein a first valve plate and a second valve plate are mounted on the actuation rod for controlling opening and closing of the first valve and the second valve, and wherein the treatment container includes a second control valve in communication with the first chamber;

a vacuum pump including a tube intercommunicating the vacuum pump with the second control valve; and a first annular block and a second annular block respectively mounted above and below the first valve plate, wherein a spacing between the first annular block and the second annular block is larger than a thickness of the first valve plate, wherein a third annular block and a fourth annular block are respectively mounted above and below the second valve plate, and wherein a spacing between the third annular block and the fourth annular block is larger than a thickness of the second valve plate.

2. The pump-storage device as claimed in claim 1, wherein the inlet of the treatment container includes a swirling member.

3. The pump-storage device as claimed in claim 1, wherein the actuation cylinder includes a push rod coupled with the actuation rod via a coupler.

4. The pump-storage device as claimed in claim 1, wherein the treatment container includes a protection unit having a compartment, wherein the compartment includes a bottom having at least one bottom hole in communication with the first chamber, wherein the compartment includes a top having a vent in communication with a passage, wherein a float is received in the compartment, and wherein the float is floatable in the compartment to permit a gas to flow between the first chamber and the compartment.

5. The pump-storage device as claimed in claim 4, wherein the float is floatable upward to block the vent to thereby prevent the gas to flow between the first chamber and the passage.

6. The pump-storage device as claimed in claim 1, wherein the actuation rod is received in a shaft sleeve, and wherein the shaft sleeve is connected to an inner wall of the first chamber by a connecting rod.

7. The pump-storage device as claimed in claim 1, wherein the treatment container includes a filtering unit, wherein the filtering unit is connected to the second control valve via a gas inlet, wherein the filtering unit includes a filter therein, and wherein the filter intercommunicates with the vacuum pump via the tube.

8. The pump-storage device as claimed in claim 7, wherein the filtering unit includes a relief valve.

9. A transportation tool including a pump-storage device as claimed in claim 1.

10. A transportation tool including a pump-storage device as claimed in claim 2.

11. A transportation tool including a pump-storage device as claimed in claim 3.

12. A transportation tool including a pump-storage device as claimed in claim 4.

13. A transportation tool including a pump-storage device as claimed in claim 5.

14. A transportation tool including a pump-storage device as claimed in claim 6.

15. A transportation tool including a pump-storage device as claimed in claim 7.

16. A transportation tool including a pump-storage device as claimed in claim 8.

* * * * *